US006397619B1

(12) United States Patent
Cheng et al.

(10) Patent No.: US 6,397,619 B1
(45) Date of Patent: Jun. 4, 2002

(54) DEHYDRATING DEVICE USED IN EVAPORATOR OF A REFRIGERATION SYSTEM

(75) Inventors: Wei-Yueh Cheng; Sheih-Pei Lin, both of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/702,984

(22) Filed: Nov. 1, 2000

(51) Int. Cl.[7] ..... F25D 21/00
(52) U.S. Cl. ..... 62/272; 62/276
(58) Field of Search ..... 62/272, 276, 151, 62/3.1

(56) References Cited

U.S. PATENT DOCUMENTS 4,224,743 A * 9/1980 Erickson et al. ..... 34/219

FOREIGN PATENT DOCUMENTS

JP 2-115678 A * 4/1990 ..... 62/151

* cited by examiner

*Primary Examiner*—William Doerrler
*Assistant Examiner*—Melvin Jones
(74) *Attorney, Agent, or Firm*—Troxell Law Office PLLC

(57) ABSTRACT

A dehydrating device used in evaporator of a refrigeration (or an air conditioner) system, in which the evaporator includes a heat-exchanging assembly, and the dehydrating device includes an electrode member mounted under lower end of the heat-exchanging assembly at a suitable space, a positive voltage source, a negative voltage source, and two time controllers connected with the positive and negative voltage sources respectively; the two voltage sources are connected with the electrode member and the lower end of the heat-exchanging assembly respectively so as to form into an electric field therebetween; the two time controllers will provide a time difference so as to control the two voltage sources to furnish a power supply on a periodical switching basis; then, the condensed water under the heat-exchanging assembly will be pulled and removed from the surface of the heat-exchanging assembly by means of the periodical change of the electric field.

10 Claims, 6 Drawing Sheets

DEHYDRATING DEVICE USED IN EVAPORATOR OF A REFRIGERATION SYSTEM

BACKGROUND OF THE INVENTION

This invention relates to a dehydrating device used in evaporator of a refrigerator (or an air conditioner) system, and particularly to use electro-hydrodynamic technique on an evaporator of a refrigeration (or an air conditioner) system so as to have the electric-charged condensed water on the evaporator removed quickly by means of an electric attractive face in order to enable the evaporator to have a better heat conductively for stepping up the operation efficiency of the refrigeration (or an air conditioner) system.

PRIOR ART.

FIG. 1 shows the cycling circuit of a conventional refrigeration (or an air conditioner) system, which usually comprises a compressor 1, a condenser 2, an expansion valve 3 and an evaporator 4. After the gaseous refrigerant of low temperature goes through the compressor 1 to be compressed into a high-pressure and high-temperature gaseous refrigerant, the refrigerant will exchange heat with the outer fluid via the condenser 2, and then it will be could into a high-pressure and mid-temperature liquid refrigerant; then, it will pass the expansion valve 3 to become a low-pressure and mid-temperature liquid refrigerant; the liquid refrigerant will then flow through the evaporator 4 to absorb the outer heat so as to provide a cold chamber; finally, the refrigerant will become a low-pressure and low-temperature gaseous refrigerant through the evaporator 4, and a whole cycle of the refrigerant is completed.

According to the aforesaid conventional cycling method of refrigerant, a fan-cooling fin pipe type of evaporator 4 is used, and it includes a zig-zag type of copper pipe used for carrying refrigerant, a plurality of fins attached to the copper pipe, and a fan to provide a blowing air; the fins are used for increasing the heat-exchanging area of the evaporator 4. The fan is used for blowing air to flow among the fins so as to provide heat-exchange between the fins and the copper pipe. Since the fins and the copper pipe have a considerable low temperature, the moisture in the flowing air will be condensed on the fins and the copper pipe; as soon as the moisture is condensed to a given weight, it will drop and flow to the bottoms of the fins and the copper pipe to drain off; most of the condensed water drips will be drained off from the bottoms of the fins.

Evidently, the condensed water drips on the evaporator will badly affect the heat-exchanging operation of the fins and the copper pipe; and also hinder air ventilation among the fins; in fact, such condensed drips would cause the motor of fan becoming overload, and cause the evaporator to have a poor and low transfer performance.

Theoretically, the shorter the condensed water stays on the fins of the evaporator and the copper pipe, the better the evaporator has more efficiency. However, the only way of removing the condensed water on a conventional evaporator 4 is by using the weight of the water drips themselves, and the weight is considered the only direct factor, while the indirect factor therefore or an auxiliary force is the collision of air flowing, the vibration the fan motor and the slight vibration of the copper pipe upon refrigerant therein flowing. In terms of experience, all the aforesaid factors would not satisfy the requirement of removing the condensed water quickly; consequently, the condensed water would still be deemed a major factor to affect the transfer performance of the evaporator.

FIG. 2 shows a patent application filed under No.8821069 in R.O.C. by the same applicant; the aforesaid application disclosed a dehydrator device 100 used in evaporator 4 of refrigeration (or an air conditioner) system; the device comprises an electrode member 5 and a voltage source 6, of which two terminals are connected with the heat-exchanging assembly (not shown) of the evaporator 4 and the electrode member 5 respectively. The electrode member 5 is mounted under the lower end of the heat-exchanging assembly 4 at a given space so as to form into an electric field between the lower end of the evaporator 4 and the electrode member 5. By means of the electric field, water drips fall, as a result of gravity, to the lower end of the heat-exchanging assembly will be removed quickly therefrom. As a result of the quick move of water drips on the heat-exchanging assembly and the centripetal force of fluid, the water will flow to the lower end of the heat-exchanging assembly rapidly.

FIG. 3 is an enlarged view, showing the relation between the condensed water drips 7 on the heat-exchanging assembly 42 (just showing an embodiment of using fins) of the evaporator 4 and the electrode member 5. Since water has a higher dielectric coefficient, it obtains electric charge easily; therefore, the condensed water drips 7 on the lower end of the heat-exchanging assembly are subject to carrying negative change; consequently, the water drips 7, in addition to gravity thereof, and the electrode member 5 will form into an electric field, which is a driving force; in other words, the water drips will be removed from the lower end of the heat-exchanging assembly 42 before being accumulated into a sufficient gravity to fall down; then, the water can be drained off of the systems thorough a pipe or other means on the evaporator 4.

As shown in FIG. 2, the conventional prior art includes a single voltage source 6 of only one period of cycling to provide a negative voltage source for the heat-exchanging assembly (not shown) of the evaporator 4 and a positive voltage source for electrode member 5 (i.e., the periodic change of the positive voltage and the negative voltage having no time difference). The voltage furnished with the voltage source 6 may be as high as several thousands of voltages (but the current being very low); when the single voltage source 6 is supplying the positive and negative voltages simultaneously, the operation of the system might have an unstable stats as a result of the positive and negative voltages being discharged at the same time; for example, the compressor might be out of order suddenly, or the push button fails to operate, or the system must be turned again; all the aforesaid problems must be improved and overcome.

SUMMARY OF THE INVENTION

The prime object of the present invention is to provide a dehydrating device used in evaporator of a refrigeration (or an air conditioner) system. The electric fluid dynamics can also be used in the device so as to have the condensed water carrying a charge on the evaporator removed quickly by means of the attractive force of the electrode member upon the water drips having very low weight, and to let the transfer performance of the evaporator reach the most effective extent in order to increase the operation efficiency of whole system; by means of controlling the voltage-changing period of the evaporator and the electrode member, a time difference can take place between the two parts; the high positive and negative voltages applied thereto at different time enable the whole system to have a higher stable operation without being out of order unintentionally.

In order to reach the aforesaid object, the preferred embodiment of the present invention is furnished with a heat-exchanging assembly in the evaporator, the heat-exchanging assembly has a lower end; the dehydrating device includes:

An electric member mounted under the lower end of the heat-exchanging assembly at a given space; the electric member is in an open-circuit condition from the heat-exchanging assembly;

Two voltage sources including a positive voltage source and a negative voltage source; the positive voltage source is connected with the electrode member, while the negative voltage source is connected with the heat-exchanging assembly so as to form into an electric filed between the two parts; and Two time controller being connected with the two voltage source respectively so as to control the power-supply periods of the two voltage sources, i.e., to have a time difference between the power-supply periods of the two voltage sources; in other words, the positive and negative voltage are supplied not simultaneously.

In the present invention, the two voltage sources can provide a period-changing electric field between the lower end of the heat-exchanging assembly and the electrode member; by means of the driving force of the electric field, the fluid condensed on the lower end of the heat-exchanging assembly can be removed from the surface of the heat-exchanging assembly.

The present invention further comprises a control unit connected between the two voltage sources and the two time controller so as to control the operation of the two time controller and the two voltage sources.

In the present invention, the electrode member is one end of the electric field, and it is substantially a conductor, such as wire, a plat plate, a pan loaded with water, or the conductive casing of the evaporator.

In the present invention, the two voltage sources of the dehydrating device are used for producing high voltage for the electric field; they can be DC voltage sources, AC voltage sources, or other voltage producing device. According to the preferred embodiment of the present invention, the voltage source is a pulse-voltage source, in which a flyback transformer is used so as to provide the electric field with a high voltage but a low current.

In the present invention, the heat-exchanging assembly of the evaporator can be a fin-structure assembly, a copper pipe structure assembly, or other structure for heat-exchanging function.

DETAILED DESCRIPTION OF THE PREFERRED EMBODIMENT

The technique electric fluid dynamics used in the dehydrating device of the present invention is that a high-voltage and low-current electric field is formed between a heat-exchanging assembly of a refrigeration (or an air conditioner) system and an outer electrode members by means of an outer power supply; by using the electric field, the condensed water drips will be driven away from the heat-exchanging assembly and to flow to the electrode members. According to the present invention, the heat-exchanging assembly includes heat-dissipation fins, a copper pipe for carrying refrigerant, and other parts for yielding condensed water drips in a refrigeration (or an air conditioner) system. Moreover, the present invention can provide the evaporator and the electrode members with a voltage-changing period to be controlled by means of two time controllers so as to produce a time difference between the two voltage-changing periods; in that case, the system would not have an unstable condition as a result of the positive and negative high voltages furnished simultaneously.

Figure 1:
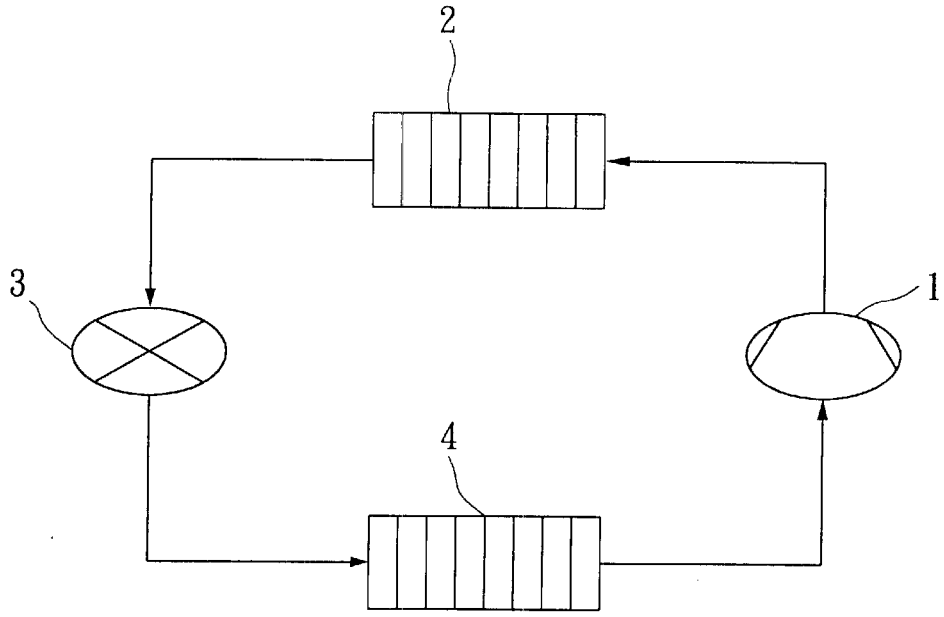
FIG. 1 (PRIOR ART)
FIG. 1 is a schematic diagram, showing the refrigeration cycle of a conventional refrigeration (or air conditioner) system.
Figure 2:
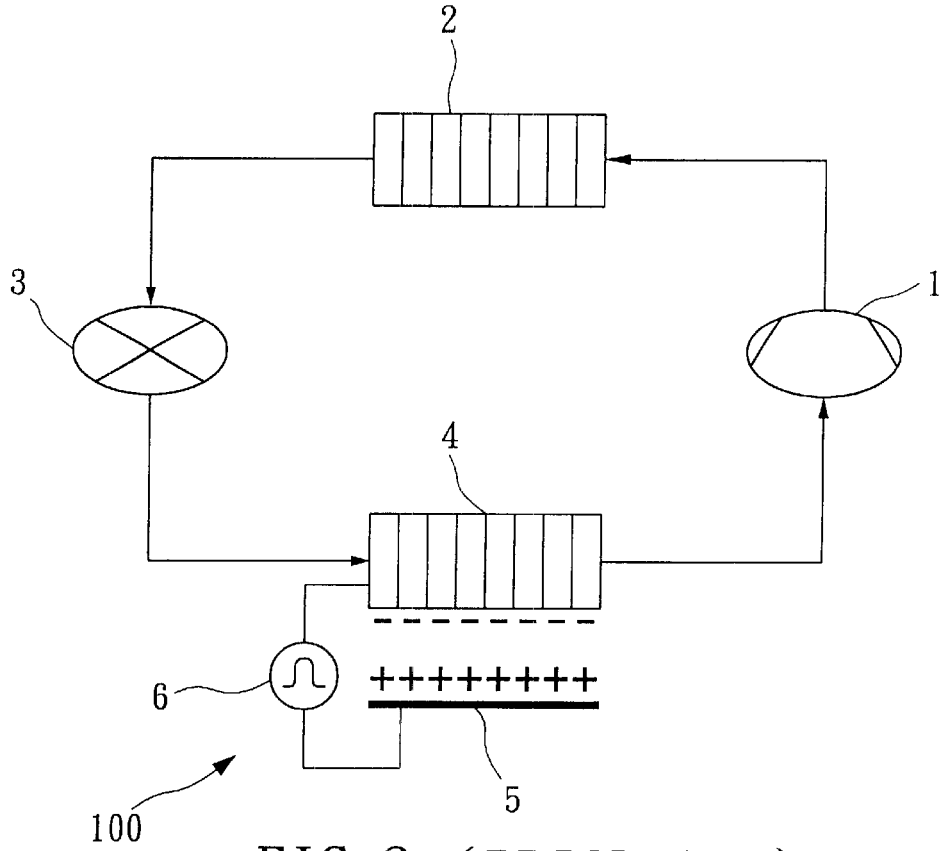
FIG. 2 (PRIOR ART)
FIG. 2 is a schematic diagram, showing the dehydrating device of an evaporator in a conventional refrigeration (or air condition) system.
Figure 3:
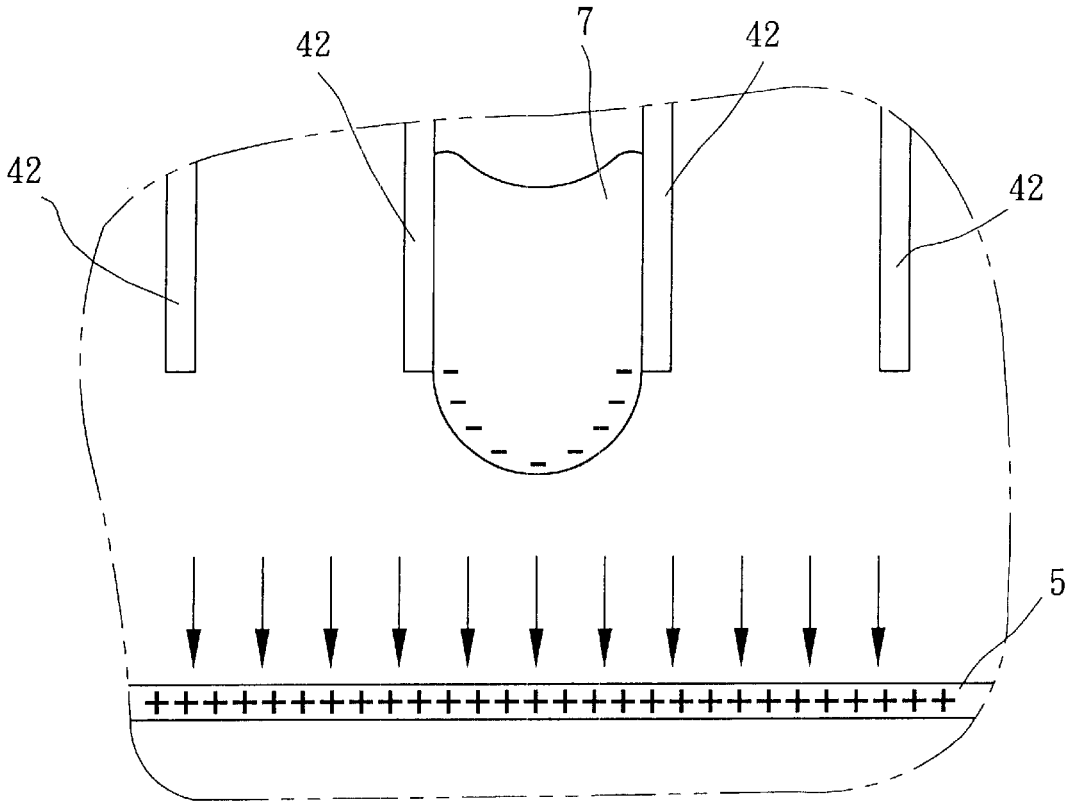
FIG. 3 (PRIOR ART)
FIG. 3 is an enlarged schematic diagram, showing the relative positions among the cooling fins of an evaporator, the condensed water and the electrodes.
Figure 4:
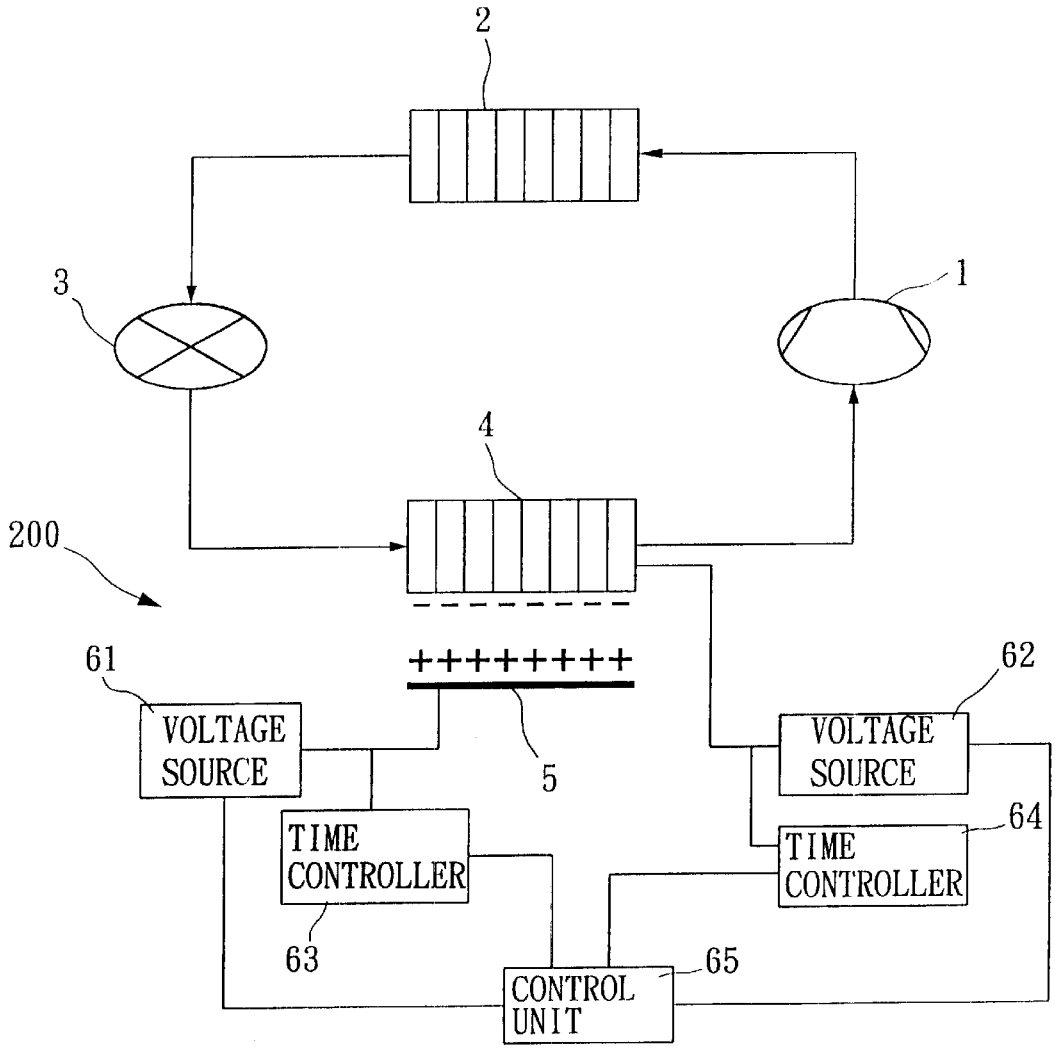
FIG. 4 is a schematic diagram of the present invention, showing the dehydrating device of an evaporator in the refrigeration (or air condition) system.

As shown in FIG. 4, a schematic diagram of a dehydrating device 200 of an evaporator in a refrigeration (or an air conditioner) system of the present invention is shown; the cycling of the refrigerant therein is the same as that described in the aforesaid background paragraph with FIGS. 1, and 2, and therefore no further description is given.

As shown in the FIGS., the dehydrating device 200 of the present invention includes at least an electrode member 5, two voltage source 61 and 62 for furnishing a positive voltage and a negative voltage, and two time controller 63 and 64 for controlling the period of cycling of the two voltage sources 61 and 62, and a control unit 65 connected with the two time controllers 63 and 64, and the two voltage sources 61 and 62. In the embodiment, the negative voltage source 62 is connected with a heat-exchanging assembly (not shown) of the evaporator 4; the positive voltage source 61 is connected with the electrode member 5; the positive and negative voltage sources 61 and 62 are connected with the time controllers 63 and 64 respectively. The time controllers 63 and 64 are to be controlled with the control unit 65 so as to control the period of cycling of the positive and negative voltage sources 61 and 62, i.e., to control the voltage-changing period of two voltage sources 61 and 62.

The heat-exchanging assembly is substantially a part of the evaporator 4; in order to facilitate description, the heat-exchanging assembly and the evaporator will be shown with the reference member "4" in following paragraphs.

The electrode member 5 is mounted under the lower end of the heat-exchanging assembly 4 at a given space, i.e., in open circuit condition from the heat-exchanging assembly 4 so as to form into an electric field between the lower end of the heat-exchanging assembly 4 and the electrode member 5. In the aforesaid embodiment, the lower end of the heat-exchanging assembly 4 is connected with a negative voltage, while the electrode member 5 is connected with a positive voltage. As a result of the electric field, the water drips fall under the heat-exchanging assembly 4, because of gravity, will be removed quickly from the heat-exchanging assembly 4. As a result of the quick moving of the condensed drips on the heat-exchanging assembly 4 and the centripetal force of a fluid, the drips will flow to the lower end of the heat-exchanging assembly 4 quickly.

Figure 5A:
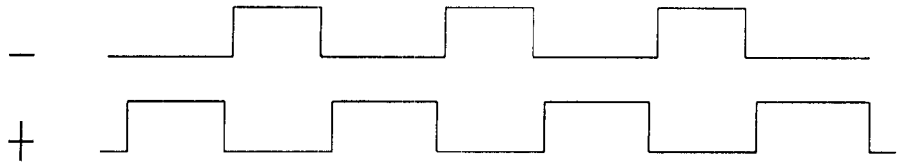
FIGS. 5A, 5B and 5C are schematic diagrams of the present invention, showing different embodiment by means of two time controls 63 and 64 for controlling and switching positive and negative voltage sources 61 and 62 of the power supply so as to produce different period of cycling at different time.
Figure 5B:
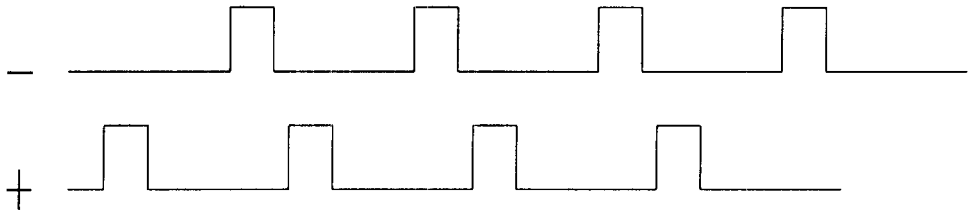
Figure 5C:
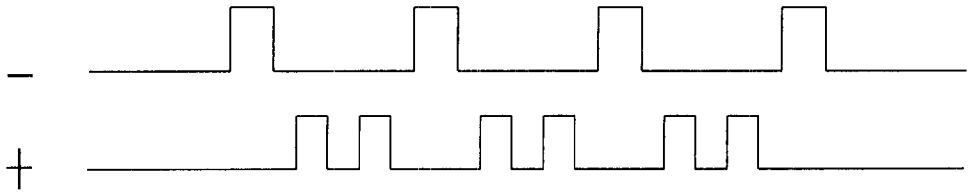

The prime feature of the present invention is that the control unit 65 is used for controlling the two time controllers 63 and 64 to have the positive and negative voltage sources 61 and 62 switch a period of cycling respectively with a given time difference so as to let the positive and negative voltage sources 61 and 62 have a phase difference, i.e., not supplying electric power at the same time; in other words, the two power sources (voltages) will provide power at different period of time; referring to FIGS. 5A, 5B and 5C, the two time controllers 63 and 64 of the present insertion can control the positive and negative voltage sources 61 and 62 to switch at different time to furnish different voltage changing periods respectively as shown in the aforesaid embodiments. By means of the switching variety of power supply period, the strength of electric field between the lower end of the heat-exchanging assembly 4 and the electrode member 5 will have a period variety; the positive and negative voltage sources will not supply simultaneously; therefore, the refrigeration system would not be unstable, and the defects in the connectional technique have been overcome.

Figure 6A:
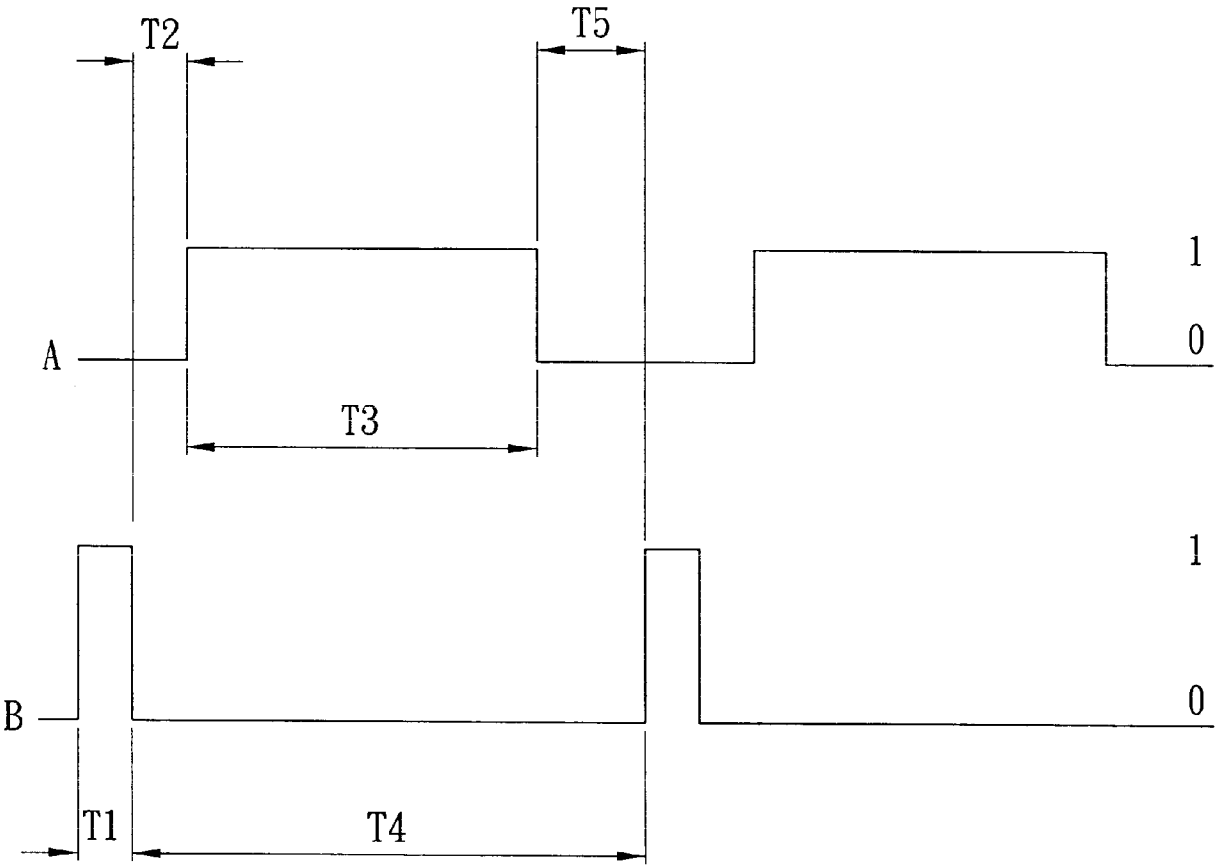
FIGS. 6A and 6B show a sequence diagram of voltage-changing period and a control flow chart of the present invention by means of a control unit 65 and time controllers 63 and 64 to control the positive voltage source 61 and the negative voltage source 62 of a power supply.
Figure 6B:
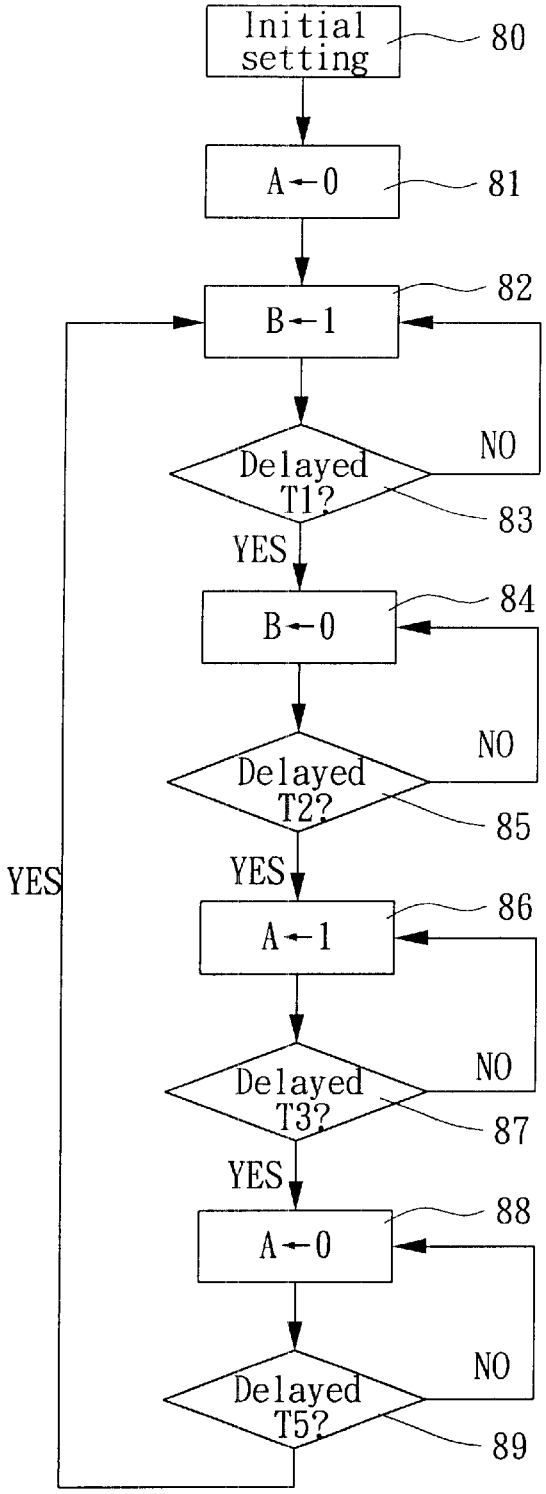

FIGS. 6A and 6B show a sequence diagram and a control flow chart respectively by means of the control unit 65 and the time controllers 63 and 64 to control the period variety of the positive and negative voltage sources 61 and 62.

As shown in FIG. 6A, the output thereof has two wave forms A and B, which are used for controlling the control unit 65 to enable the two time controller 64 and 63 to produce the switching power supply. In the aforesaid FIGS. T1 indicates the time of the output value 1 (i.e., there is a power supply) of the wave form B; T2 indicates the time difference between the output value O (i.e., there is no power supply output) and the output value of the wave form A being changed from "O" to "I" (i.e., there is a power supply. T3 indicates the time duration of the wave form A having an output value "1", T4 indicates the time duration of the wave form B having an -output value "O"; T5 indicates a time difference upon the output value of wave form A being changed from "1" to "0", and upon output value of wave form B being changed from "0" to "1"; then, we can know:

$$T5=T4-(T2+T3).$$

FIG. 6 shows a simple embodiment of the control flow chart of the control unit 65, which includes steps as follows:

Step 80—a beginning setting value.

Step 81—set the output value of wave form A at "0".

Step 82—the output value of wave form B being set at "1".

Step 83—the time controller indicates timing; see if a T1 time has been delayed or not; if the answer is "no", it will return to step 82; if the answer is "yes" it will enter step 84.

Step 84—set the output value of the wave form B at "0".

Step 85—the time controller indicates timing; see if a T2 time has been delayed or not; if the answer is "no", it will return to step 84; if a T1 time has been delayed, it will enter step 86.

Step 86—set the output value of the wave form A at "1".

Step 87—the time controller indicates timing; see if a T3 time has been delayed or not; if the answer is "no", it will return to step 86; if a T1 time has been delayed, it will enter step 88.

Step 88—set the output value of the wave form A at "0".

Step 89—the time controller indicates timing; see if a T5 time has been delayed or not; if the answer is "no", it will return to step 88"; if a T1 time has been delayed, it will return to step 82, i.e., to repeat the next period of cycling.

In the present invention, the electrode member 5 may be a conductive wire, or a plate mounted under the lower end of the heat-exchanging assembly, or a single part on the bottom of the evaporator 4, or the like. The length of the electrode member 5 is approximately equal to the width of the heat-exchanging assembly. If the electrode member 5 is a plate, it is better to have passage or hole to let a fluid flow through.

In the present invention, the voltage sources 61 and 62 furnished in the dehydrating device 200 are used for producing a suitable electric field between the heat-exchanging assembly 4 and the electrode member 5; the voltage sources 61 and 62 can be a DC voltage source, an AC voltage source (together with a rectifier), or other voltage producing devices, which are used for providing a voltage source having a high voltage and a low current. In the preferred embodiment of the present invention, the two voltage source are two pulse-voltage sources, which include a flyback transformer (not shown) so as to provide an electric field having a high voltage and a low current. In the present invention, the electrode member 5 is made of conductive metal, and the shape thereof and the space form the heat-exchanging assembly 4 are not specified particularly; furthermore, the structure and the value of the voltage output of the two voltage sources 61 and 62 are not specified particularly; however, the result of dehydrating is related to the strength of the electric field between the electrodes (such as the voltage, the shape and space between the electrodes, and the polarity of the electric field). In case of the voltage being too high or the space between two electrodes being too small, a discharge or a heat-circuit would take place in the electric field; therefore, a preferred electrode member 5 in terms of material and shape, a preferred heat-exchanging assembly 4 in terms of space and two preferred voltage sources 61 and 62 in terms of output voltage have been selected through experiment out of different sets of devices; likewise, suitable insulation and shield among the electrode members 5, the voltage sources 61 and 62 or the heat-exchanging assembly should also be done properly so as to have the dehydrating of condensed water had the most efficiency. The parameter of the preferred embodiment has a close relation with the model, power, location and other condition of the dehydration devices 200; the experiment methods can easily be carried out by a person who is familiar with the art concerned, and therefore no further details are given.

In the present invention, the aforesaid pulse-voltage sources 61 and 62 can be obtained by using a conventional device or circuit which can produce a high-voltage pulse. In the preferred embodiment of the present invention, the flyback transformer (not shown) of the pulse-voltage sources 61 and 62, the circuit used to produce a high voltage and a low current, the control unit 65 and the time controllers 63 and 64 can easily be obtained by a person who is familiar with the conventional art, and therefore no further details are given.

The inventor of the present invention has made repeated experiments and adjustments for the material and the shape of the electrode members, for the space from the evaporator, the output voltage of the pulse-voltage source, and the power-supply period of the time controller; therefore, the discharge or shortcircuit problem, which might take place, between the evaporator and the electrode members has been overcome. It is noted that, after the aforesaid device is actually used in an air-conditioner or a dehumidifier (as shown in the reference FIG. of enclosure 1) under the same operation condition, the present invention can exhaust additional 15% condensed water than a conventional device as a result of the gravity effect and the periodical change of the electric field under the control of the time controller; consequently, the present invention can remove the condensed water off the evaporator have a fall efficiency on transfer performance, and then the operation efficiency of a refrigeration system or an air conditioner can be stepped up considerably without having the problems of discharge and short-circuit.

The present invention has been described in detail by means of the preferred embodiment as mentioned above, but it is not used as a limit to the scope of the present invention; any person, who is skilled in the field, may make minor modification and adjustment thereto, but such modification and adjustment will be deemed within the scope and spirit of the present invention.

Summing up the aforesaid description, it is deemed that the present invention is a concrete and practical device to conform to the requirements of a utility model under the patent law, and therefore a letters patent thereof is solicited.

What is claimed is:

1. A dehydrating device for an evaporator of a refrigeration system, comprising: a heat-exchanging assembly with a dehydrating device mounted under a lower end thereof, said dehydrating device including:

an electrode member being substantially as conductor spaced from the lower end of said heat-exchanging assembly, said conductor being in an open-circuit from said heat-exchanging assembly;

two voltage sources including a positive voltage source connected with said electrode member, and a negative voltage source connected with said heat-exchanging assembly so as to form an electric field between said electrode member and said heat-exchanging assembly; and, two time controllers, each connected with one of said two voltage sources respectively so as to control a period of cycling of power supply of said two voltage sources, and to furnish a periodic change of said electric field between said electrode member and said heat-exchanging assembly.

2. The dehydrating device for an evaporator of a refrigeration system as claimed in claim 1, wherein said electrode member is a conductive wire.

3. The dehydrating device for an evaporator of a refrigeration system as claimed in claim 1, wherein said electrode member is a flat-plate.

4. The dehydrating device for an evaporator of a refrigeration system as claimed in claim 1, wherein said voltage sources are pulse-voltage sources.

5. The dehydrating device for an evaporator of a refrigeration system as claimed in claim 4, wherein said pulse-voltage sources include a flyback transformer so as to enable said electric field to furnish a high voltage with a low current.

6. The dehydrating device for an evaporator of a refrigeration system as claimed in claim 1, wherein said heat-exchanging assembly is a fin-structure member.

7. The dehydrating device for an evaporator of a refrigeration system as claimed in claim 1, where in s aid two time controllers control the period change of said two voltage sources respectively at a time difference, whereby power supply is not furnished simultaneously.

8. The dehydrating device for an evaporator of a refrigeration system as claimed in claim 1, further comprising a control unit connected between said two voltage sources and said two time controllers for controlling operations of said time controllers and said voltage sources.

9. A dehydrating device for an evaporator of a refrigeration system wherein the evaporator includes a heat-exchanging assembly and comprising:

an electrode member mounted beneath a lower portion of said heat-exchanging assembly forming an open-circuit condition from said heat-exchanging assembly;

said electrode member and said heat-exchanging assembly connected with a positive voltage source and a negative voltage source respectively; a control unit for controlling time connected between said two voltage sources so as to enable said two voltage sources to provide power periodically at different time so as to provide a periodically changing electric field between said electrode member and said heat-exchanging assembly.

10. The dehydrating device for an evaporator of a refrigeration system as claimed in claim 9, further comprising two time controllers connected with said two voltage sources respectively, and said control unit being connected between said two time controllers.

* * * * *